US006386884B1

(12) United States Patent
Sloey

(10) Patent No.: US 6,386,884 B1
(45) Date of Patent: May 14, 2002

(54) ROTATABLE CONNECTOR SYSTEM

(75) Inventor: Jason S. Sloey, Riverside, CA (US)

(73) Assignee: Northstar Systems, Inc., Rancho Cucamonga, CA (US)

( * ) Notice: Subject to any disclaimer, the term of this patent is extended or adjusted under 35 U.S.C. 154(b) by 0 days.

(21) Appl. No.: 09/624,673

(22) Filed: Jul. 24, 2000

Related U.S. Application Data

(60) Provisional application No. 60/203,806, filed on May 12, 2000.

(51) Int. Cl.[7] ..... H01R 39/00
(52) U.S. Cl. ..... 439/11; 439/31; 439/660
(58) Field of Search ..... 439/11, 1, 13, 439/31, 660

(56) References Cited

U.S. PATENT DOCUMENTS

| | | | | |
|---|---|---|---|---|
| 4,632,475 A | * 12/1986 | Tomita | 439/31 |
| 4,657,320 A | * 4/1987 | Bamford et al. | 439/31 |
| 4,701,133 A | * 10/1987 | Worth | 439/13 |
| 4,877,409 A | * 10/1989 | Tanigawa et al. | 439/31 |
| 4,975,062 A | * 12/1990 | Evans et al. | 439/31 |
| RE34,430 E | 11/1993 | Mosquera et al. | 439/248 |
| 5,888,087 A | 3/1999 | Hanson et al. | 439/374 |
| 6,017,233 A | 1/2000 | Fry et al. | 439/248 |
| 6,019,630 A | 2/2000 | Alpert | 439/501 |
| 6,045,393 A | 4/2000 | Alpert | 439/418 |

FOREIGN PATENT DOCUMENTS

| | | | |
|---|---|---|---|
| JP | 0072588 | * 3/1989 | 439/31 |
| JP | 0267980 | * 10/1989 | 439/31 |

* cited by examiner

*Primary Examiner*—Tho D. Ta
(74) *Attorney, Agent, or Firm*—Wilson Sonsini Goodrich & Rosati

(57) ABSTRACT

A connector system. In one embodiment, the connector system includes a receptacle housing with a plurality of receptacle electrical contacts fixedly attached thereto, and a plug housing comprising a plurality of plug electrical contacts fixedly attached thereto. Each of the plug electrical contacts comprises a proximal end that includes a blade in a first plane. The proximal end is connectable to a first electronic component. Each of the plug electrical contacts further comprises a distal end that includes a blade substantially in a second plane that is orthogonal to the first plane. When the plug housing is inserted in the receptacle housing, the distal end is in contact with a respective one of the plug electrical contacts, and the plug housing and the receptacle housing are rotatable with respect to each other in the second plane.

9 Claims, 4 Drawing Sheets

ROTATABLE CONNECTOR SYSTEM

RELATED APPLICATION

This patent application claims priority from United States Provisional Patent Application No. 60/203,806, filed May 12, 2000.

FIELD OF INVENTION

This invention generally relates to electrical connector systems with plugs and receptacles.

BACKGROUND OF THE INVENTION

Many electrical devices must be easily connected to and disconnected from another device that serves as an electrical signal source or sink for the device. For example, many hand-held devices such as personal data assistants (PDAs) and global positioning system (GPS) devices must be repeatedly connected to and disconnected from mating devices. The mating devices may charge the power supply of the hand-held device or transfer data to and from the hand-held device. A common example is a PDA and its cradle. The PDA functions independently, but can be placed in the cradle to make electrical connections through which the PDA communicates with a computer or some other device. Conventional connector systems have disadvantages in such applications. For example, parts of either the hand-held device or the mating device may be broken in use.

The electrical connectors in the hand-held device must be easily aligned with the electrical connectors in the mating device so that a user can quickly and frequently place the hand-held device properly in the mating device. One conventional solution is to include alignment pins on one or both of the handle-device and the mating device. The alignment pins or even the electrical contacts are often broken off, however, because the user fails to pull the hand-held device out of the mating device in a direction parallel to the alignment pins and mating contacts. Alignment pins or electrical contacts may also be broken during placement of the hand-held device in the mating device.

Conventional approaches to connectors include "floating" connectors. For example, electrical panels in "drawers" may be installed into a rack that includes a guiding mechanism and a mechanism that allows the device to float relative to the mated connectors. Floating connectors are limited, however, because the allowed movement is restricted to movement of the mated connectors in a plane of the installed panel. When the drawer is installed, connectors in the drawer mate with connectors in the rack in a plane. In the conventional drawer connector system, movement of the drawer connectors with respect to the rack connectors, or pivoting of one of the connectors outside of the plane while maintaining the electrical connection with the other connector, is not allowed.

SUMMARY OF THE DISCLOSURE

A connector system with a plug and a socket is described. The connector system allows rotation of the plug and the socket with respect to each other while the plug and the socket are electrically coupled. Embodiments of the connector system help to prevent component and connector damage during coupling and uncoupling of mating components. In one embodiment, the connector system includes a receptacle housing with a plurality of receptacle electrical contacts fixedly attached thereto, and a plug housing comprising a plurality of plug electrical contacts fixedly attached thereto. Each of the plug electrical contacts comprises a proximal end that includes a blade in a first plane. The proximal end is connectable to a first electronic component. Each of the plug electrical contacts further comprises a distal end that includes a blade substantially in a second plane that is orthogonal to the first plane. When the plug housing is inserted in the receptacle housing, the distal end is in contact with a respective one of the plug electrical contacts, and the plug housing and the receptacle housing are rotatable with respect to each other in the second plane.

DETAILED DESCRIPTION

Figure 1:
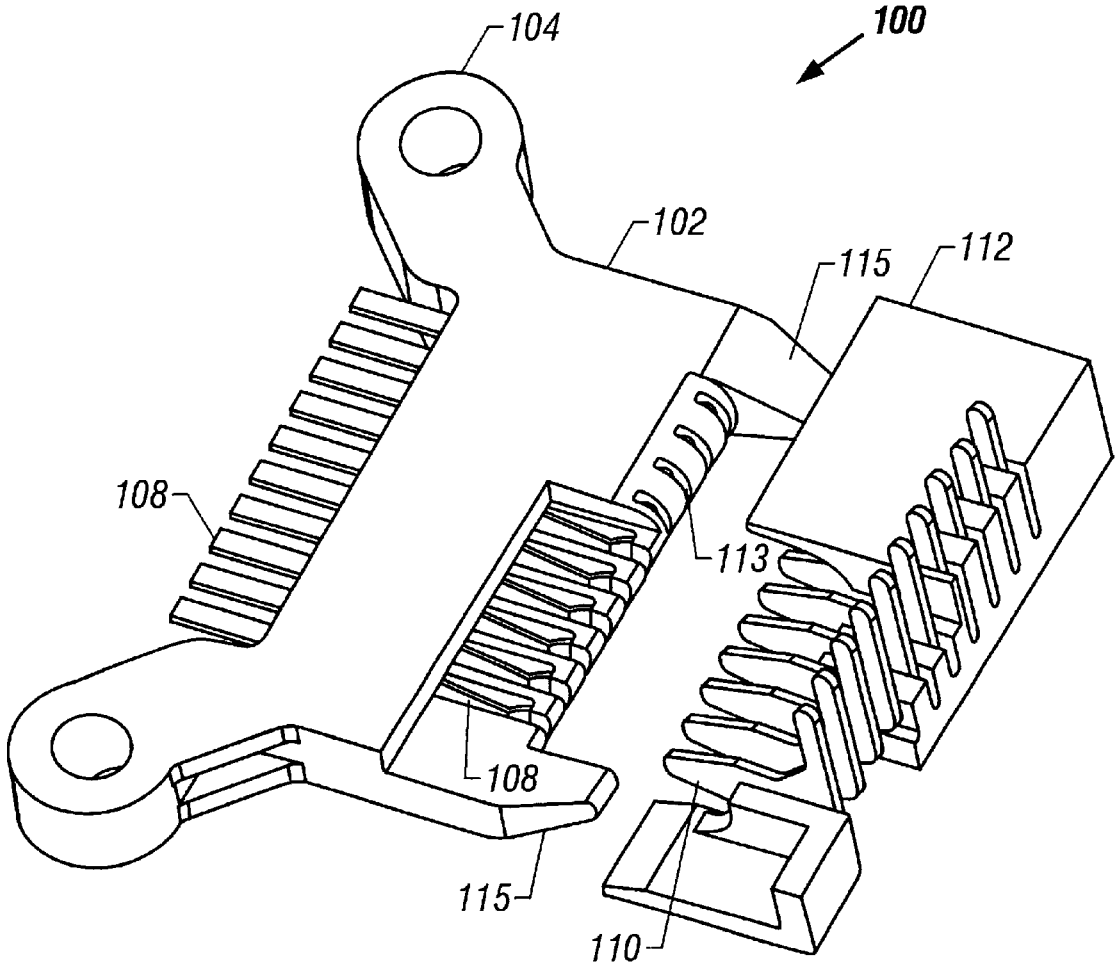
FIG. 1 is a perspective cutaway view of one embodiment of a rotatable connector system.

A connector system with a plug and socket is described. The connector system allows rotation of the plug and socket with respect to each other while the plug and socket are electrically coupled. Embodiments of the connector system help to prevent component and connector damage during coupling and uncoupling of mating components. FIG. 1 is a diagram of an embodiment of a connector system 100. The connector system 100 includes a plug housing 102 and a receptacle housing 112. Portions of the plug housing 102 and the receptacle housing 112 are cut away to show contacts 108 and 110. Reference number 110 indicates a representative receptacle electrical contact. The receptacle electrical contact 110 is fixedly attached to the receptacle housing 112. The receptacle electrical contact 110 is a single piece of conductive material in a blade shape with a ninety degree angle between its two ends. One end of the receptacle electrical contact 110 is a mating end that is accessible through an opening in the receptacle housing 112. As shown in FIG. 1, all of the mating ends of the receptacle electrical contacts 110 are accessible through a single opening in the receptacle housing 112 that faces the plug housing 102. The ends of the receptacle electrical contacts 110 opposite the mating ends may be electrically connected to an electrical component either removably or permanently.

The plug housing 102 includes two bosses 104 that allow the plug housing 102 to be connected to a component, for example by screws inserted through the holes in the bosses 104. The plug housing 102 further includes two tapered ears 115 that fit into the opening in the receptacle housing 112. Between tapered ears 115, multiple guide openings 113 in the plug housing 102 each accept one mating end of a receptacle electrical contact 110. Each plug electrical contact 108 includes a distal end accessible through the guide opening 113 and a proximal end that projects between the bosses 104. Each plug electrical contact 108 is fixedly attached to the plug housing 102 between its distal end and its proximal end. The proximal ends of the plug electrical contacts 108 may be electrically connected, removably or permanently, to an electrical component. The proximal ends of the plug electrical contacts 108 are blades in one plane. The distal ends of the plug electrical contacts 108 are the distal sections of the same blades bent to be substantially in a plane orthogonal to the plane of the proximal ends. When the plug housing 102 is inserted in the receptacle housing 112, the mating end of a receptacle electrical contact 110 is placed in physical contact with a distal end of a respective plug electrical contact 108. The plug housing 102 and the receptacle housing 112 are rotatable with respect to each other while the electrical connection between the plug electrical contacts 108 and the receptacle electrical contacts 110 is maintained. The limits of rotation are defined by the ears 115 making contact with sides of the opening in the receptacle housing 112 in which the ears 115 are inserted. In one embodiment, the plug housing 102 and the receptacle housing 112 may rotate through an angle of up to thirty degrees with respect to each other.

In various embodiments, the number of plug electrical contacts 108 and the number of receptacle electrical contacts 110 varies according to need. For example, one embodiment has four plug electrical contacts 108 and the same number of receptacle electrical contacts 110. Another embodiment has twenty plug electrical contacts 108 and the same number of receptacle electrical contacts 110. In general, according to the components that are to be electrically coupled through the connector system 100, the number of plug and receptacle contact pairs may vary between one and twenty or more pairs of contacts.

In one embodiment, the plug housing 102 and the receptacle housing 112 are made of glass reinforced thermoplastic. In various embodiments, the plug housing 102 and the receptacle housing 112 may be made of any relatively rigid insulating material with the appropriate wear characteristics. In one embodiment, the receptacle electrical contacts 110 and the plug electrical contacts 108 are made of a copper alloy plated with gold. The receptacle electrical contacts 110 and the plug electrical contacts 108 may be made of any conducting material with the appropriate electrical and mechanical characteristics for the required application. The material should be resilient such that the distal ends of the plug electrical contacts retain resilience after being preshaped as shown in FIG. 2A.

Figure 2C:
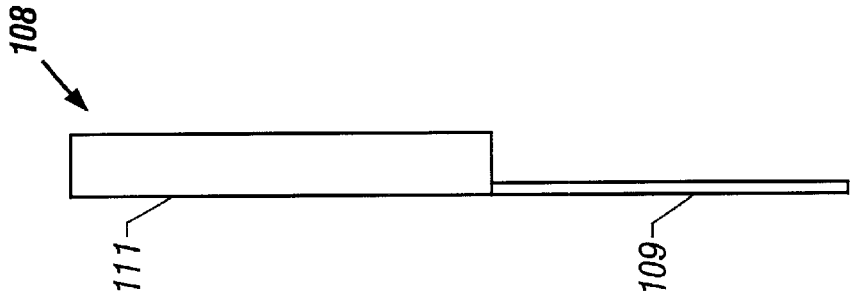
FIG. 2A is a diagram of an embodiment of a plug electrical contact.
FIG. 2B is a diagram of different view of the plug electrical contact of FIG. 2A.
Figure 2B:
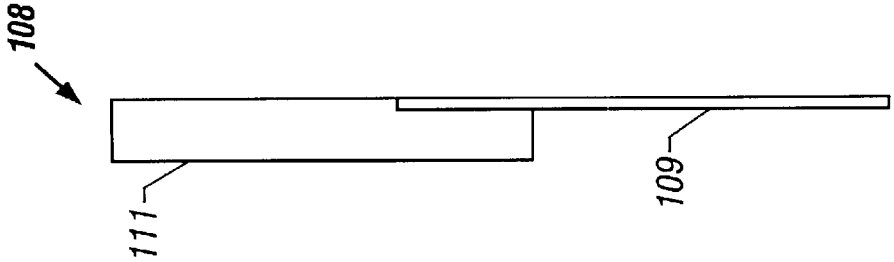
Figure 2A:
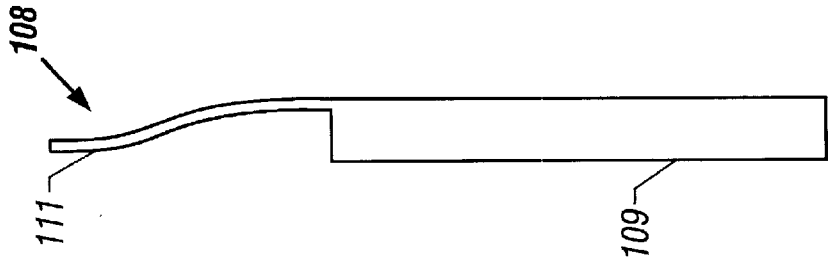

FIG. 2A is a diagram of a plug electrical contact 108, showing the distal end 111 and the proximal end 109. In one embodiment, the plug electrical contact 108 is a single piece of a resilient, conductive material. The distal end 111 is preshaped so as to remain biased against the mating end of a respective receptacle electrical contact 110. FIG. 2B is a right side view of the plug electrical contact 108 of FIG. 2A, and FIG. 2C is a left side view of the plug electrical contact 108 of FIG. 2A.

Figure 3:
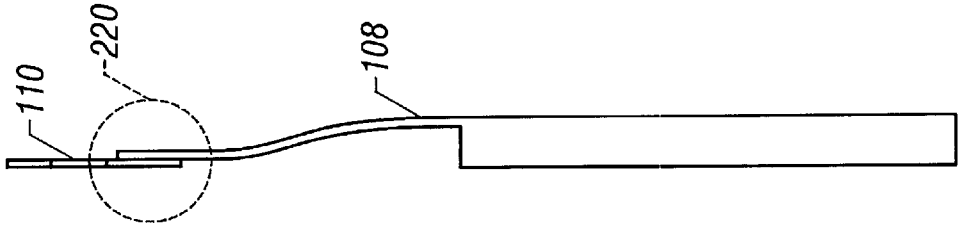
FIG. 3 is a diagram of an embodiment of a plug electrical contact in the mated position with respect to an embodiment of a receptacle electrical contact.

FIG. 3 is a diagram of a plug electrical contact 108 in a mated position with a receptacle electrical contact 110. The area 220 is the area of electrical contact and the point about which the plug electrical contact 108 and the receptacle electrical contact 110 rotate with respect to each other.

Figure 4:
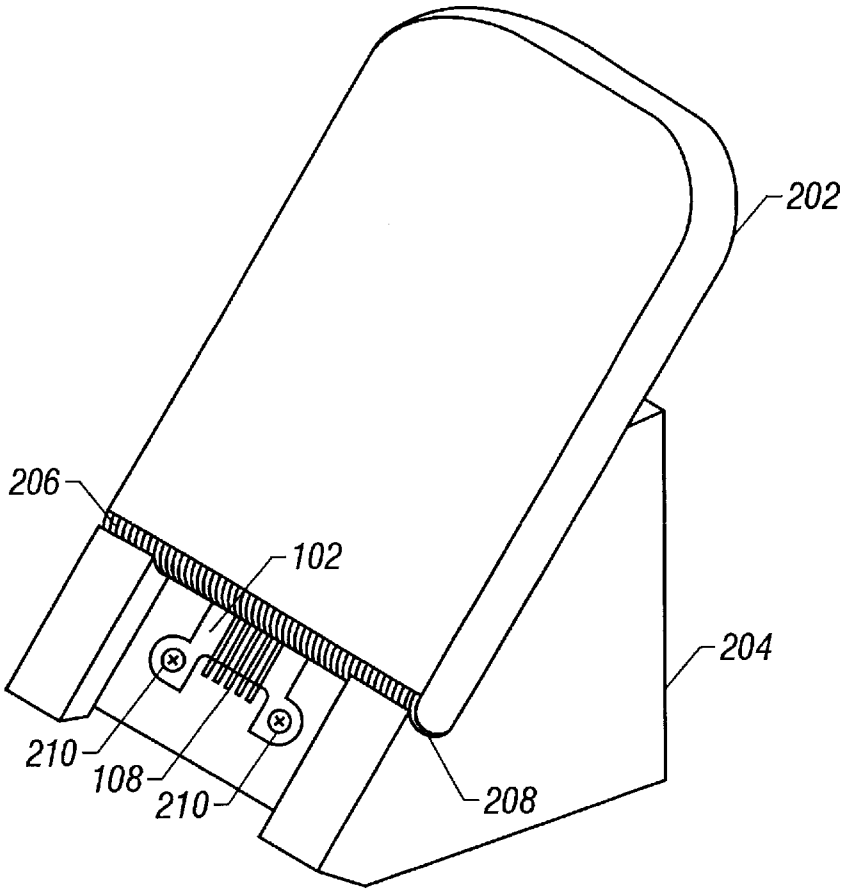
FIG. 4 is a perspective view of an embodiment of a rotatable connector system installed in a hand-held device and mating cradle.

FIG. 4 is a diagram of one embodiment in which the connector system 100 is used to couple a hand-held device 202 and a cradle 204. The cradle 204 may be a source of power for recharging or may facilitate communication between the hand-held device 202 and, for example, a personal computer. The hand-held device may be any hand-held electrical component, such as a personal data assistant (PDA), that must occasionally communicate with another electrical component. The hand-held device 202 rests in the cradle in a curved rest area 208. The hand-held device includes a curved area 206 that fits into the curved rest area 208 and allows easy rotation of the hand-held device 202 with respect to the cradle 204. When the hand-held device 202 is placed in the cradle 204 or removed from the cradle 204, the natural path of motion is not straight into and out of the cradle 204 in line with the contacts 108 and 110 of the plug housing 102 and the receptacle housing 112. Rather, the natural path includes placing lateral stress on the connector 100. For example, a user removing the hand-held device 202 from the cradle 204 naturally pulls the hand-held device out from the cradle 204 either before or at the same time the user pulls the hand-held device 202 up in line with the connector 100. The connector 100 allows rotation of the plug housing 102 and its contacts 108 with respect to the receptacle housing 112 and its contacts 110. Connector system 100 thus alleviates the problem of inadvertent component and contact damage on insertion and removal of the hand-held device 202.

The plug housing 102 is shown connected to the cradle 204 by screws 210 through the bosses 104. The proximal ends of the plug electrical contacts 108 are visible inside and outside the plug housing 102 in this case because the plug housing 102 is made of a transparent insulator material. In other embodiments, the plug housing 102 may not be transparent, in which case only the tips of the proximal ends of the plug electrical contacts 108 extending beyond the plug housing 102 would be visible. A connector (not shown) may be removably coupled to the proximal ends of the plug electrical contacts 108 to couple the connector 100 directly or indirectly to some device, such as a personal computer. In other embodiments, the plug electrical contacts 108 may be permanently coupled to another connector or to a device or component, for example by soldering the proximal ends.

Figure 5:
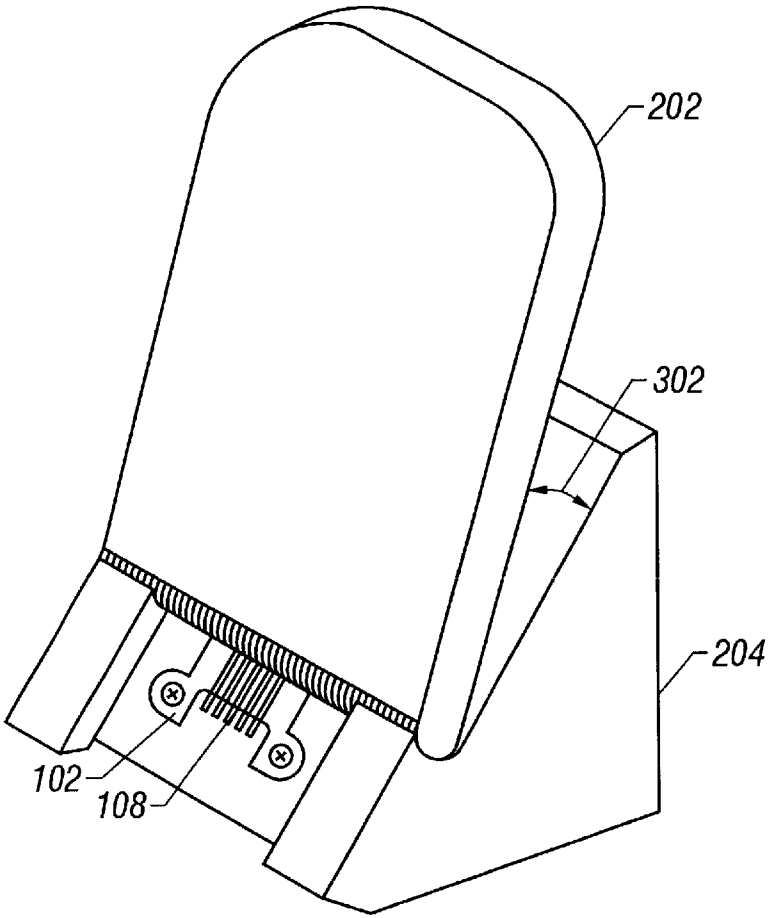
FIG. 5 is a perspective view of the hand-held device and mating cradle of FIG. 4 in a rotated position.

FIG. 5 is a diagram of the hand-held device 202 coupled to the cradle 204 through the connector 100. In this diagram, the hand-held device 202 is rotated through an angle 302 with respect to the cradle 204. In one embodiment, the angle 302 represents one half of the total rotation possible. In various embodiments, the total angle of rotation available may be variously distributed between a direction to one side of the connector 100 and a direction to the opposite side of the connector 100. For example, in some embodiments, the cradle 204 may hold the plug connector 102 in a vertical position and allow rotation out of the vertical in two directions. In one embodiment, the total angle of rotation is less than or equal to thirty degrees.

Figure 6:
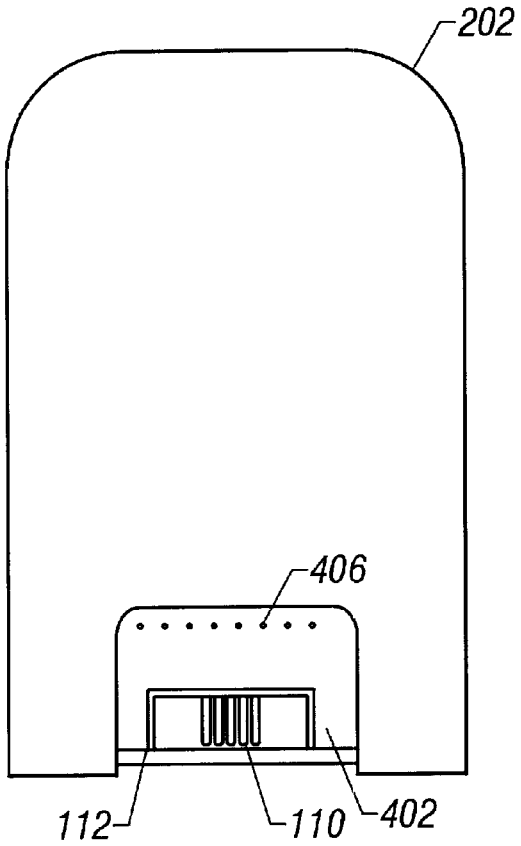
FIG. 6 is a diagram of a receptacle of an embodiment installed in hand-held device.

FIG. 6 is a diagram showing the side of the hand-held device 202 that faces the cradle 204 (and is therefore not visible in FIGS. 4 and 5). The hand-held device 202 includes a circuit board 402 containing electrical components necessary to make it function. Part of the circuit board 402 is visible because a region of the hand-held device 202 casing is cut away, as shown. The receptacle housing 112 is shown. The receptacle housing 112 appears as it would if it were made of a transparent insulating material so that all of the mating ends of the receptacle electrical connections are visible. The ends opposite the mating ends (not shown) are inserted into the circuit board 402 and are permanently coupled to electrical contacts on the side of the circuit board 402 that is not shown. For example, each of the receptacle electrical contacts 110 may be soldered, in which case, solder dots such as solder dots 406 would be visible on the circuit board 402.

In one embodiment of the connector system 100 suitable for a common PDA device and cradle, the connector system has a current rating of one amp, a dielectric withstanding voltage of 400 volt alternating current, and an insulation resistance of 1000 megaohms. Typical mechanical characteristics of such an embodiment include a 5000 cycle life, a contact normal force of 3.5 pounds, a withdrawal force of 0.7 pounds, minimum, and an operating temperature range of from −10° C. to +105° C.

Figure 7A:
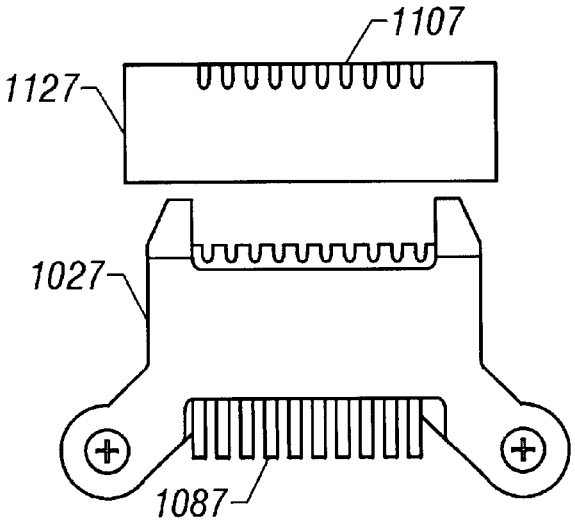
FIG. 7A is a diagram of one embodiment of a plug and receptacle.
Figure 7B:
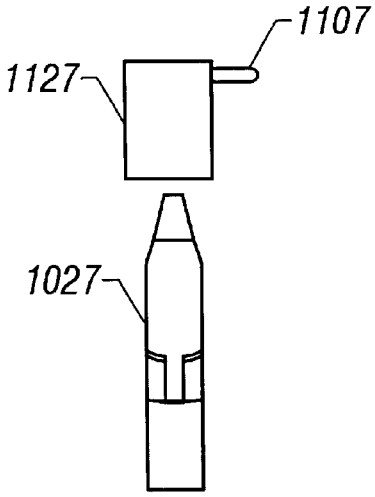
FIG. 7B is a diagram showing another view of the plug and receptacle of FIG. 7A.

FIG. 7A is a diagram of one embodiment of a connector system having ten sets of plug electrical contacts 1087 and receptacle electrical contacts 1107. A plug housing 1027 is shown with its dimensions, and a receptacle housing 1127 is shown with its dimensions. FIG. 7B is a diagram showing a side view of the plug housing 1027 with its dimensions, and a side view of the receptacle housing 1127 with its dimensions.

The invention has been described with reference to specific embodiments. Various modifications may be made by one of ordinary skill in the art without departing from the spirit and scope of the invention as defined in the following claims. For example, alternative materials, different dimensions, and different configurations are within the scope of the invention as claimed. In addition, the connector system described may used to electrically couple, directly or indirectly, any components other than the components specifically shown and described.

What is claimed is:

1. A connector system comprising:

a receptacle housing comprising a plurality of receptacle electrical contacts fixedly attached thereto, wherein each of the plurality of receptacle electrical contacts comprises:

a respective distal end such that a plurality of receptacle electrical contact distal ends are aligned to be substantially parallel in a first plane the plurality of receptacle electrical contact distal ends are accessible through a single opening in the receptacle housing; and a respective proximal end such that a plurality of receptacle electrical contact proximal ends are aligned to be substantially parallel in a second plane that is orthogonal to the first plane, wherein the receptacle electrical contact proximal ends are connectable to a first electronic component; and a plug housing comprising a plurality of plug electrical contacts fixedly attached thereto, wherein each of the plug electrical contacts comprises, a respective proximal end such that a plurality of plug electrical contact proximal ends are aligned in a row that is substantially parallel in the first plane, wherein the plug electrical contact proximal ends are connectable to a second electronic component; and a respective distal end such that a plurality of plug electrical contact distal ends are aligned in a row that is substantial parallel in the first plane, wherein when the plug housing is inserted in the receptacle housing, the distal end is in contact with a respective one of the receptacle electrical contacts, and the plug housing and the receptacle housing are rotatable with respect to each other in a third plane that is orthogonal to the second plane and orthogonal to the first plane.

2. The connector system of claim 1, wherein the plug housing and the receptacle housing are rotatable through an angle of up to thirty degrees.

3. The connector system of claim 1, wherein the first electrical component is a hand-held electronic device, and wherein the second electrical component is a cradle in which the hand-held device may rest while being communicatively coupled to the cradle through the connector system.

4. The connector system of claim 1, wherein the plurality of receptacle electrical contacts and the plurality of plug electrical contacts each comprises between one and twenty electrical contacts.

5. The connector system of claim 1, wherein the plurality of receptacle electrical contacts and the plurality of plug electrical contacts each comprises a copper alloy plated with gold.

6. The connector system of claim 1, wherein the plug housing and the receptacle housing each comprise a glass reinforced thermoplastic material.

7. The connector system of claim 1, wherein:

an insertion force required to insert the plug housing into the receptacle housing is less than or equal to 3.5 pounds; and a withdrawal force required to withdraw the plug housing from the receptacle housing is at least 0.7 pounds.

8. The connector system of claim 1, wherein the plug housing further comprises a plurality of guide openings, wherein each of guide opening houses a plug electrical contact distal end, and wherein each of said plug electrical contact distal ends is preshaped of a resilient material such that when the plug housing is inserted into the receptacle housing, each of the plug electrical contact distal ends remains biases in electrical contact with a respective receptacle electrical contact distal end during rotation of the plug housing and receptacle housing with respect to each other.

9. The connector system of claim 8, wherein the plug housing further comprises an ear on each end of the row of plug electrical contact distal ends, wherein each of the ears is shaped so as to fit within an opening in the receptacle housing, and further shaped so as to limit the amount of rotation of the plug housing and the receptacle housing with respect to each other.

* * * * *